US012459628B2

(12) United States Patent
Ikegaya

(10) Patent No.: US 12,459,628 B2
(45) Date of Patent: Nov. 4, 2025

(54) MARINE PROPULSION SYSTEM AND MARINE VESSEL

(71) Applicant: YAMAHA HATSUDOKI KABUSHIKI KAISHA, Iwata (JP)

(72) Inventor: Yuji Ikegaya, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 224 days.

(21) Appl. No.: 17/972,600

(22) Filed: Oct. 25, 2022

(65) Prior Publication Data

US 2023/0140525 A1 May 4, 2023

(30) Foreign Application Priority Data

Nov. 4, 2021 (JP) ..... 2021-180207

(51) Int. Cl.

| | |
|---|---|
| ***B63H 25/42*** | (2006.01) |
| ***B63H 20/00*** | (2006.01) |
| ***B63H 20/12*** | (2006.01) |
| ***B63H 21/20*** | (2006.01) |
| ***B63H 25/02*** | (2006.01) |
| ***B63H 25/04*** | (2006.01) |

(52) U.S. Cl.

CPC ..... *B63H 25/42* (2013.01); *B63H 20/12* (2013.01); *B63H 2020/003* (2013.01); *B63H 2021/205* (2013.01); *B63H 2025/026* (2013.01); *B63H 25/04* (2013.01)

(58) Field of Classification Search

CPC ..... B63H 25/42; B63H 20/12; B63H 25/04; B63H 2020/003; B63H 2021/205; B63H 2025/026; B63H 2025/425

See application file for complete search history.

(56) References Cited

U.S. PATENT DOCUMENTS 6,350,164 B1 2/2002 Griffith, Sr. et al.
6,579,133 B1 6/2003 Harris
(Continued)

FOREIGN PATENT DOCUMENTS

EP 3000718 A1 3/2016
EP 3210879 A1 8/2017
(Continued)

OTHER PUBLICATIONS

Extended European Search Report in EP22202717.9, mailed Mar. 27, 2023, 7 pages.

*Primary Examiner* — Anne Marie Antonucci
*Assistant Examiner* — Luis G Del Valle
(74) *Attorney, Agent, or Firm* — Keating & Bennett, LLP

(57) ABSTRACT

A marine propulsion system includes a main propulsion device, an auxiliary propulsion device including an electric motor to drive an auxiliary thruster, and a controller configured or programmed to perform an automatic marine vessel maneuvering control to direct a bow or a stern of a hull to a target point by rotating the hull and maintain the hull, the bow or the stern of which has been directed to the target point, at the target point by moving the hull in a forward-rearward direction. The controller is configured or programmed to rotate the hull by driving the auxiliary thruster while stopping a main thruster of the main propulsion device in the automatic marine vessel maneuvering control.

20 Claims, 5 Drawing Sheets

(56) References Cited

U.S. PATENT DOCUMENTS

| | | | | |
|---|---|---|---|---|
| 2009/0298359 | A1* | 12/2009 | Hiroshima | G05D 1/495 440/1 |
| 2012/0083172 | A1* | 4/2012 | Al Babtain | B63H 23/30 440/49 |
| 2015/0072575 | A1* | 3/2015 | Mizutani | B63H 20/12 440/1 |
| 2015/0166159 | A1* | 6/2015 | Inoue | B63H 20/12 440/53 |
| 2017/0152003 | A1* | 6/2017 | Mascellaro | B63B 1/20 |
| 2019/0179318 | A1* | 6/2019 | Miller | B63H 25/42 |
| 2021/0139123 | A1* | 5/2021 | Osara | B63H 21/14 |
| 2021/0255640 | A1* | 8/2021 | Imamura | G01C 21/203 |
| 2022/0269289 | A1* | 8/2022 | Imamura | B63H 25/04 |

FOREIGN PATENT DOCUMENTS

| | | | |
|---|---|---|---|
| JP | 2000-344193 | A | 12/2000 |
| JP | 2012-245979 | A | 12/2012 |

* cited by examiner

MARINE PROPULSION SYSTEM AND MARINE VESSEL

CROSS REFERENCE TO RELATED APPLICATIONS

This application claims the benefit of priority to Japanese Patent Application No. 2021-180207 filed on Nov. 4, 2021. The entire contents of this application are hereby incorporated herein by reference.

BACKGROUND OF THE INVENTION

1. Field of the Invention

The present invention relates to a marine propulsion system and a marine vessel.

2. Description of the Related Art

A marine propulsion system including a main propulsion device and an auxiliary propulsion device is known in general. Such a marine propulsion system is disclosed in Japanese Patent Laid-Open No. 2000-344193, for example.

Japanese Patent Laid-Open No. 2000-344193 discloses an automatic return navigation device including a main propulsion device, an auxiliary propulsion device, and a controller that performs a control to maintain a hull at a target point specified by a user. When a distance from the hull to the target point exceeds a predetermined distance with the main and auxiliary propulsion devices stopped, the controller drives only the auxiliary propulsion device to move (return) the hull to the target point. The controller stops the auxiliary propulsion device again when the hull returns to the target point. In the control to return the hull to the target point, only the auxiliary propulsion device is driven instead of driving both the main propulsion device and the auxiliary propulsion device. The auxiliary propulsion device is provided to one side of a centerline of the hull in a right-left direction in a plan view such that a rotational moment is applied to the hull when a thrust is generated, the auxiliary propulsion device is not steered with respect to the hull to change the direction of the thrust, and the auxiliary propulsion device moves (returns) the hull to the target point by turning the hull due to the rotational moment. The term "turning" indicates moving forward or rearward while gradually changing the orientation of a bow. Therefore, the position of the hull is not maintained when the hull is turned.

Although not clearly described in Japanese Patent Laid-Open No. 2000-344193, conventionally, there has been known an automatic marine vessel maneuvering control (Fish Point™ control) to rotate a bow or a stern to a target point and maintain a hull at the target point by moving the hull in a forward-rearward direction. When the control to return the hull to the target point described in Japanese Patent Laid-Open No. 2000-344193 is applied to such an automatic marine vessel maneuvering control, a control is conceivably performed to drive only the auxiliary propulsion device instead of driving both the main propulsion device and the auxiliary propulsion device. However, in such a case, it is necessary to make a turn in which the position of the hull is not maintained in order to move (return) the hull to the target point with only the auxiliary propulsion device, and adjusting the orientation of the hull also changes the position of the hull. Thus, the position holding accuracy is conceivably low. Recent years, in the field of marine vessels, from the viewpoint of SDGs (Sustainable Development Goals), it is desired to reduce environmental burdens, such as reducing the amount of carbon dioxide emissions associated with driving of propulsion devices of marine vessels.

SUMMARY OF THE INVENTION

Preferred embodiments of the present invention provide marine propulsion systems and marine vessels that each improve a position holding accuracy in automatic marine vessel maneuvering controls to rotate bows or sterns of hulls including main and auxiliary propulsion devices to target points and maintain the hulls at the target points by moving the hulls in a forward-rearward direction while reducing environmental burdens associated with driving of propulsion devices as much as possible.

A marine propulsion system according to a preferred embodiment of the present invention includes a main propulsion device including a main thruster and operable to rotate in a right-left direction to change a direction of a thrust, an auxiliary propulsion device including an electric motor to drive an auxiliary thruster to generate a thrust, operable to rotate in the right-left direction to change a direction of the thrust, and having a maximum output smaller than a maximum output of the main propulsion device, and a controller configured or programmed to perform an automatic marine vessel maneuvering control to direct a bow or a stern of a hull to a target point by rotating the hull and maintain the hull, the bow or the stern of which has been directed to the target point, at the target point by moving the hull in a forward-rearward direction. The controller is configured or programmed to rotate the hull by driving the auxiliary thruster while stopping the main thruster in the automatic marine vessel maneuvering control. The terms "rotating the hull" and "rotate the hull" indicate changing the orientation of the bow while maintaining the position of the hull, unlike turning of the hull accompanied by forward or rearward movement of the hull.

A marine propulsion system according to a preferred embodiment of the present invention includes the controller configured or programmed to perform a control to rotate the hull by driving the auxiliary thruster driven by the electric motor of the auxiliary propulsion device operable to rotate in the right-left direction to change the direction of the thrust while stopping a main thruster of the main propulsion device in the automatic marine vessel maneuvering control (Fish Point™ control) to direct the bow or the stern of the hull to the target point by rotating the hull and maintain the hull, the bow or the stern of which has been directed to the target point, at the target point by moving the hull in the forward-rearward direction. Accordingly, the hull is rotated by the auxiliary propulsion device by rotating the auxiliary propulsion device in the right-left direction while the position of the hull is maintained. That is, unlike turning accompanied by forward or rearward movement of the hull, the orientation of the hull is changed by the auxiliary propulsion device while the position of the hull is maintained. Consequently, in the Fish Point™ control (the automatic marine vessel maneuvering control to direct the bow or the stern of the hull including the main propulsion device and the auxiliary propulsion device to the target point by rotating the hull and maintain the hull at the target point by moving the hull in the forward-rearward direction), the position holding accuracy is improved. Furthermore, the auxiliary propulsion device includes the electric motor to drive the auxiliary thruster to generate a thrust. Accordingly, as compared with a case in which the auxiliary propulsion device is an engine propulsion device, the amount of carbon dioxide emitted from the auxiliary propulsion device is reduced. Thus, in the Fish Point™ control (the automatic marine vessel maneuvering control to direct the bow or the stern of the hull including the main propulsion device and the auxiliary propulsion device to the target point by rotating the hull and maintain the hull at the target point by moving the hull in the forward-rearward direction), the position holding accuracy is improved while environmental burdens associated with driving of the propulsion devices are reduced as much as possible.

In a marine propulsion system according to a preferred embodiment of the present invention, the main propulsion device is preferably attached to the stern and is preferably provided on a centerline of the hull in the right-left direction, and the auxiliary propulsion device is preferably attached to the stern and is preferably provided to one side of the centerline of the hull in the right-left direction. Accordingly, the auxiliary propulsion device is spaced farther apart from the center of gravity of the hull as compared with the main propulsion device, and thus a relatively large rotational moment is generated by the auxiliary propulsion device at the time of rotating the hull. Therefore, the hull is more quickly rotated.

In a marine propulsion system according to a preferred embodiment of the present invention, the controller is preferably configured or programmed to move the hull in the forward-rearward direction by driving the main thruster of the main propulsion device while stopping the auxiliary thruster in the automatic marine vessel maneuvering control. Accordingly, rotation of the hull and movement of the hull in the forward-rearward direction are performed by different propulsion devices, and thus rotation of the hull and movement of the hull in the forward-rearward direction are smoothly switched.

In a marine propulsion system according to a preferred embodiment of the present invention, the controller is preferably configured or programmed to rotate the hull by driving the auxiliary thruster while stopping the main thruster without rotating the main propulsion device in the right-left direction in the automatic marine vessel maneuvering control. Accordingly, the main propulsion device is not rotated in the right-left direction when the hull is rotated, and thus the hull is prevented from swinging due to rotation of the main propulsion device in the right-left direction. Furthermore, noise generated from the main propulsion device is reduced, and thus scaring away fish during fishing, for example, is reduced or prevented.

In such a case, the main propulsion device is preferably operable to maintain a rudder angle of the main thruster at a rudder angle along a centerline of the hull in the right-left direction while stopping the main thruster when the hull is rotated by driving the auxiliary thruster in the automatic marine vessel maneuvering control. Accordingly, when the hull is rotated, the main propulsion device is kept on standby at the rudder angle along the centerline of the hull in the right-left direction, which corresponds to the rudder angle of the main thruster, and thus a thrust is immediately generated in the forward-rearward direction from the main thruster without changing the rudder angle of the main propulsion device after the rotation is completed.

In a marine propulsion system according to a preferred embodiment of the present invention, the controller is preferably configured or programmed to rotate the hull about a center of gravity of the hull on the spot while holding a position of the hull. Accordingly, the hull is rotated on the spot without substantially changing the position of the hull, and thus the position holding accuracy is further improved in the Fish Point™ control (the automatic marine vessel maneuvering control to direct the bow or the stern of the hull including the main propulsion device and the auxiliary propulsion device to the target point by rotating the hull and maintain the hull at the target point by moving the hull in the forward-rearward direction).

In such a case, the auxiliary propulsion device preferably has a right-left rotatable angle range to change the direction of the thrust larger than a right-left rotatable angle range of the main propulsion device. Accordingly, the hull is rotated (pivot-turned) by the electric motor-driven (electric) auxiliary propulsion device that has the right-left rotatable angle range to change the direction of the thrust larger than the right-left rotatable angle range of the main propulsion device such that a change in the position of the hull becomes smaller.

A marine propulsion system including the controller configured or programmed to move the hull in the forward-rearward direction by driving the main thruster while stopping the auxiliary thruster preferably further includes a thrust adjustment operator to receive an operation to adjust thrust magnitudes of the main propulsion device and the auxiliary propulsion device, and the marine propulsion system is preferably operable to switch from a first driving state in which the hull is moved in the forward-rearward direction by driving the main thruster while the auxiliary thruster is stopped to a second driving state in which the hull is moved in the forward-rearward direction by driving the auxiliary thruster while the main thruster is stopped, based on the thrust adjustment operator receiving an operation to change the thrust magnitudes to predetermined levels or less in the automatic marine vessel maneuvering control. Accordingly, the first driving state is switched to the second driving state such that the hull is rotated and moved in the forward-rearward direction by the auxiliary thruster driven by the electric motor in the Fish Point™ control (the automatic marine vessel maneuvering control to direct the bow or the stern of the hull including the main propulsion device and the auxiliary propulsion device to the target point by rotating the hull and maintain the hull at the target point by moving the hull in the forward-rearward direction), and thus quietness in the Fish Point™ control is improved, and environmental burdens are reduced.

In a marine propulsion system according to a preferred embodiment of the present invention, the controller is preferably configured or programmed to perform a control to rotate the hull and a control to move the hull in the forward-rearward direction at different timings in the automatic marine vessel maneuvering control. Accordingly, rotating the hull to change the orientation of the bow and moving the hull in the forward-rearward direction to change the position of the hull are separated from each other such that a change in the position of the hull during rotation of the hull is reduced or prevented, and a change in the orientation of the bow during movement of the hull is reduced or prevented.

In a marine propulsion system according to a preferred embodiment of the present invention, the main propulsion device is preferably an engine outboard motor including an engine to drive a main propeller corresponding to the main thruster and provided on a centerline of the hull in the right-left direction, and the auxiliary propulsion device is preferably an electric outboard motor including the electric motor to drive an auxiliary propeller corresponding to the auxiliary thruster and provided to one side of the centerline of the hull in the right-left direction. Accordingly, environmental burdens are reduced due to driving of the electric outboard motor, and the Fish Point™ control (the automatic marine vessel maneuvering control to direct the bow or the stern of the hull including the main propulsion device and the auxiliary propulsion device to the target point by rotating the hull and maintain the hull at the target point by moving the hull in the forward-rearward direction) is performed on the hull including the engine outboard motor and the electric outboard motor.

A marine propulsion system according to a preferred embodiment of the present invention includes a main propulsion device including a main thruster and operable to rotate in a right-left direction to change a direction of a thrust, an auxiliary propulsion device including an auxiliary thruster and operable to rotate in the right-left direction to change a direction of a thrust and having a maximum output smaller than a maximum output of the main propulsion device, and a controller configured or programmed to perform an automatic marine vessel maneuvering control to direct a bow or a stern of a hull to a target point by rotating the hull and maintain the hull, the bow or the stern of which has been directed to the target point, at the target point by moving the hull in a forward-rearward direction. The controller is configured or programmed to rotate the hull by driving the auxiliary thruster to generate the thrust from the auxiliary propulsion device while stopping the main thruster in the automatic marine vessel maneuvering control.

A marine propulsion system according to a preferred embodiment of the present invention includes the controller configured or programmed to perform a control to rotate the hull by driving the auxiliary thruster driven by the electric motor of the auxiliary propulsion device operable to rotate in the right-left direction to change the direction of the thrust while stopping the main thruster in the automatic marine vessel maneuvering control (Fish Point™ control) to direct the bow or the stern of the hull to the target point by rotating the hull and maintain the hull, the bow or the stern of which has been directed to the target point, at the target point by moving the hull in the forward-rearward direction. Accordingly, the hull is rotated by the auxiliary propulsion device by rotating the auxiliary propulsion device in the right-left direction while the position of the hull is maintained. That is, unlike turning accompanied by forward or rearward movement of the hull, the orientation of the hull is changed by the auxiliary propulsion device while the position of the hull is maintained. Consequently, in the Fish Point™ control (the automatic marine vessel maneuvering control to direct the bow or the stern of the hull including the main propulsion device and the auxiliary propulsion device to the target point by rotating the hull and maintain the hull at the target point by moving the hull in the forward-rearward direction), the position holding accuracy is improved.

A marine vessel according to a preferred embodiment of the present invention includes a hull and a marine propulsion system provided on or in the hull. The marine propulsion system includes a main propulsion device including a main thruster and operable to rotate in a right-left direction to change a direction of a thrust, an auxiliary propulsion device including an electric motor to drive an auxiliary thruster to generate a thrust, operable to rotate in the right-left direction to change a direction of the thrust, and having a maximum output smaller than a maximum output of the main propulsion device, and a controller configured or programmed to perform an automatic marine vessel maneuvering control to direct a bow or a stern of the hull to a target point by rotating the hull and maintain the hull, the bow or the stern of which has been directed to the target point, at the target point by moving the hull in a forward-rearward direction. The controller is configured or programmed to rotate the hull by driving the auxiliary thruster while stopping the main thruster in the automatic marine vessel maneuvering control.

A marine vessel according to a preferred embodiment of the present invention includes the controller configured or programmed to perform a control to rotate the hull by driving the auxiliary thruster driven by the electric motor of the auxiliary propulsion device operable to rotate in the right-left direction to change the direction of the thrust while stopping the main thruster in the automatic marine vessel maneuvering control (Fish Point™ control) to direct the bow or the stern of the hull to the target point by rotating the hull and maintain the hull, the bow or the stern of which has been directed to the target point, at the target point by moving the hull in the forward-rearward direction. Accordingly, the hull is rotated by the auxiliary propulsion device by rotating the auxiliary propulsion device in the right-left direction while the position of the hull is maintained. That is, unlike turning accompanied by forward or rearward movement of the hull, the orientation of the hull is changed by the auxiliary propulsion device while the position of the hull is maintained. Consequently, in the Fish Point™ control (the automatic marine vessel maneuvering control to direct the bow or the stern of the hull including the main propulsion device and the auxiliary propulsion device to the target point by rotating the hull and maintain the hull at the target point by moving the hull in the forward-rearward direction), the position holding accuracy is improved. Furthermore, the auxiliary propulsion device includes the electric motor to drive the auxiliary thruster to generate a thrust. Accordingly, as compared with a case in which the auxiliary propulsion device is an engine propulsion device, the amount of carbon dioxide emitted from the auxiliary propulsion device is reduced. Thus, in the Fish Point™ control (the automatic marine vessel maneuvering control to direct the bow or the stern of the hull including the main propulsion device and the auxiliary propulsion device to the target point by rotating the hull and maintain the hull at the target point by moving the hull in the forward-rearward direction), the position holding accuracy is improved while environmental burdens associated with driving of the propulsion devices are reduced as much as possible.

In a marine vessel according to a preferred embodiment of the present invention, the main propulsion device is preferably attached to the stern and is preferably provided on a centerline of the hull in the right-left direction, and the auxiliary propulsion device is preferably attached to the stern and is preferably provided to one side of the centerline of the hull in the right-left direction. Accordingly, the auxiliary propulsion device is spaced farther apart from the center of gravity of the hull as compared with the main propulsion device, and thus a relatively large rotational moment is generated by the auxiliary propulsion device at the time of rotating the hull. Therefore, the hull is more quickly rotated.

In a marine vessel according to a preferred embodiment of the present invention, the controller is preferably configured or programmed to move the hull in the forward-rearward direction by driving the main thruster of the main propulsion device while stopping the auxiliary thruster of the auxiliary propulsion device in the automatic marine vessel maneuvering control. Accordingly, rotation of the hull and movement of the hull in the forward-rearward direction are performed by different propulsion devices, and thus rotation of the hull and movement of the hull in the forward-rearward direction are smoothly switched.

In a marine vessel according to a preferred embodiment of the present invention, the controller is preferably configured or programmed to rotate the hull by driving the auxiliary thruster while stopping the main thruster without rotating the main propulsion device in the right-left direction in the automatic marine vessel maneuvering control. Accordingly, the main propulsion device is not rotated in the right-left direction when the hull is rotated, and thus the hull is prevented from swinging due to rotation of the main propulsion device in the right-left direction. Furthermore, noise generated from the main propulsion device is reduced, and thus scaring away fish during fishing, for example, is reduced or prevented.

In such a case, the main propulsion device is preferably operable to maintain a rudder angle of the main thruster at a rudder angle along a centerline of the hull in the right-left direction while stopping the main thruster when the hull is rotated by driving the auxiliary thruster in the automatic marine vessel maneuvering control. Accordingly, when the hull is rotated, the main propulsion device is kept on standby at the rudder angle along the centerline of the hull in the right-left direction, which corresponds to the rudder angle of the main thruster, and thus a thrust is immediately generated in the forward-rearward direction from the main thruster without changing the rudder angle of the main propulsion device after the rotation is completed.

In a marine vessel according to a preferred embodiment of the present invention, the controller is preferably configured or programmed to rotate the hull about a center of gravity of the hull on the spot while holding a position of the hull. Accordingly, the hull is rotated on the spot without substantially changing the position of the hull, and thus the position holding accuracy is further improved in the Fish Point™ control (the automatic marine vessel maneuvering control to direct the bow or the stern of the hull including the main propulsion device and the auxiliary propulsion device to the target point by rotating the hull and maintain the hull at the target point by moving the hull in the forward-rearward direction).

In such a case, the auxiliary propulsion device preferably has a right-left rotatable angle range to change the direction of the thrust larger than a right-left rotatable angle range of the main propulsion device. Accordingly, the hull is rotated (pivot-turned) by the electric motor-driven (electric) auxiliary propulsion device that has the right-left rotatable angle range to change the direction of the thrust larger than the right-left rotatable angle range of the main propulsion device such that a change in the position of the hull becomes smaller.

In a marine vessel including the controller configured or programmed to move the hull in the forward-rearward direction by driving the main thruster while stopping the auxiliary thruster, the marine propulsion system preferably further includes a thrust adjustment operator to receive an operation to adjust thrust magnitudes of the main propulsion device and the auxiliary propulsion device, and is preferably operable to switch from a first driving state in which the hull is moved in the forward-rearward direction by driving the main thruster while the auxiliary thruster is stopped to a second driving state in which the hull is moved in the forward-rearward direction by driving the auxiliary thruster while the main thruster is stopped, based on the thrust adjustment operator receiving an operation to change the thrust magnitudes to predetermined levels or less in the automatic marine vessel maneuvering control. Accordingly, the first driving state is switched to the second driving state such that the hull is rotated and moved in the forward-rearward direction by the auxiliary thruster driven by the electric motor in the Fish Point™ control (the automatic marine vessel maneuvering control to direct the bow or the stern of the hull including the main propulsion device and the auxiliary propulsion device to the target point by rotating the hull and maintain the hull at the target point by moving the hull in the forward-rearward direction), and thus quietness in the Fish Point™ control is improved, and environmental burdens are reduced.

In a marine vessel according to a preferred embodiment of the present invention, the controller is preferably configured or programmed to perform a control to rotate the hull and a control to move the hull in the forward-rearward direction at different timings in the automatic marine vessel maneuvering control. Accordingly, rotating the hull to change the orientation of the bow and moving the hull in the forward-rearward direction to change the position of the hull are separated from each other such that a change in the position of the hull during rotation of the hull is reduced or prevented, and a change in the orientation of the bow during movement of the hull is reduced or prevented.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

The structure of a marine vessel 100 including a marine propulsion system 102 according to preferred embodiments of the present invention is now described with reference to FIGS. 1 to 10.

In the figures, arrow FWD represents the forward movement direction of the marine vessel 100 in a forward-rearward direction, and arrow BWD represents the rearward movement direction of the marine vessel 100 in the forward-rearward direction. Arrow R represents the starboard direction of the marine vessel 100 in a right-left direction (a direction perpendicular to the forward-rearward direction), and arrow L represents the portside direction of the marine vessel 100 in the right-left direction.

Figure 1:
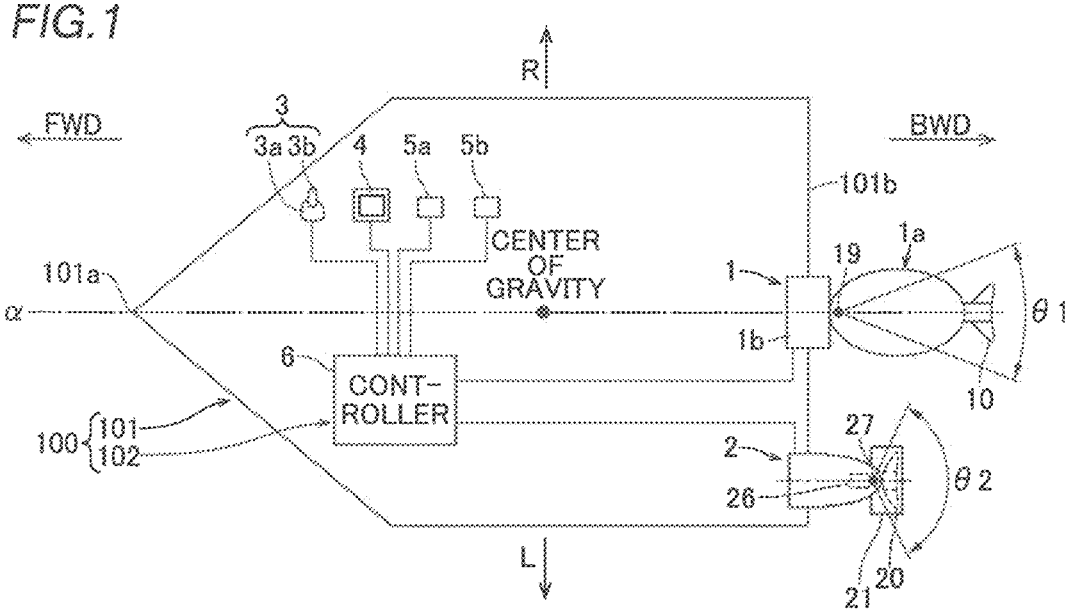
FIG. 1 is a schematic view showing a marine vessel including a marine propulsion system and a hull according to a preferred embodiment of the present invention.

As shown in FIG. 1, the marine vessel 100 includes a hull 101 and the marine propulsion system 102 provided on or in the hull 101. The hull 101 may be a hull of a fishing boat or a fishing vessel for a user to fish, for example.

The marine propulsion system 102 includes a main propulsion device 1, an auxiliary propulsion device 2, a joystick 3, a display 4 that displays navigation-related information, etc., an orientation sensor 5*a*, a position sensor 5*b*, and a controller 6. The joystick 3, the display 4, the orientation sensor 5*a*, the position sensor 5*b*, and the controller 6 are mounted on or in the hull 101.

The marine propulsion system 102 (controller 6) performs a Fish Point™ control to direct a stern 101*b* (or a bow 101*a*) of the hull 101 to a target point A1 (see FIG. 7) by rotating the hull 101 and maintain the hull 101, the bow 101*a* or the stern 101*b* of which has been directed to the target point A1, at the target point A1 by moving the hull 101 in the forward-rearward direction. The Fish Point™ is an example of an "automatic marine vessel maneuvering control".

In the Fish Point™ control, the controller 6 rotates the hull 101 by driving an auxiliary propeller 20 while stopping a main propeller 10 that generates a thrust from the main propulsion device 1. In the Fish Point™ control, the hull 101 is automatically rotated and moved in the forward-rearward direction without the user maneuvering the marine vessel. The Fish Point™ control is described below in detail. The main propeller 10 is an example of a "main thruster". The auxiliary propeller 20 is an example of an "auxiliary thruster".

Figure 2:
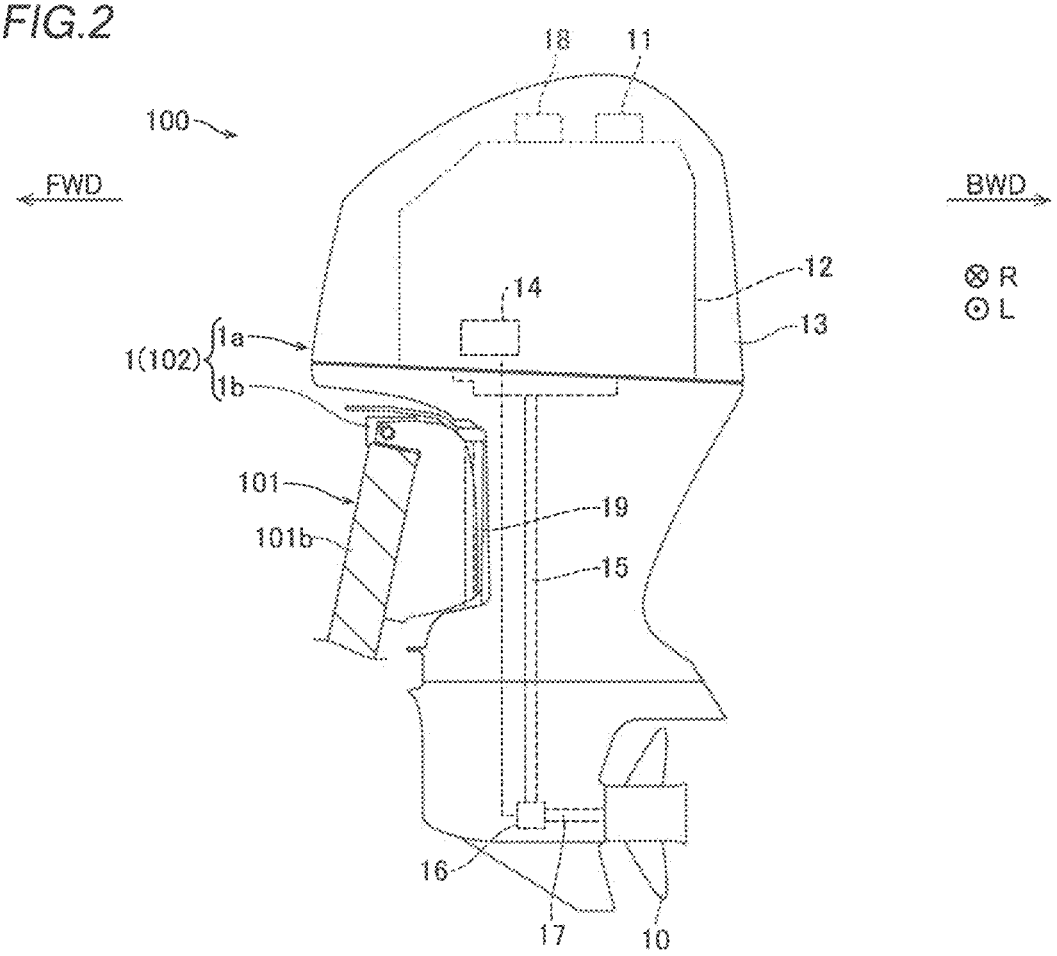
FIG. 2 is a side view showing a main propulsion device of a marine propulsion system according to a preferred embodiment of the present invention.
Figure 4:
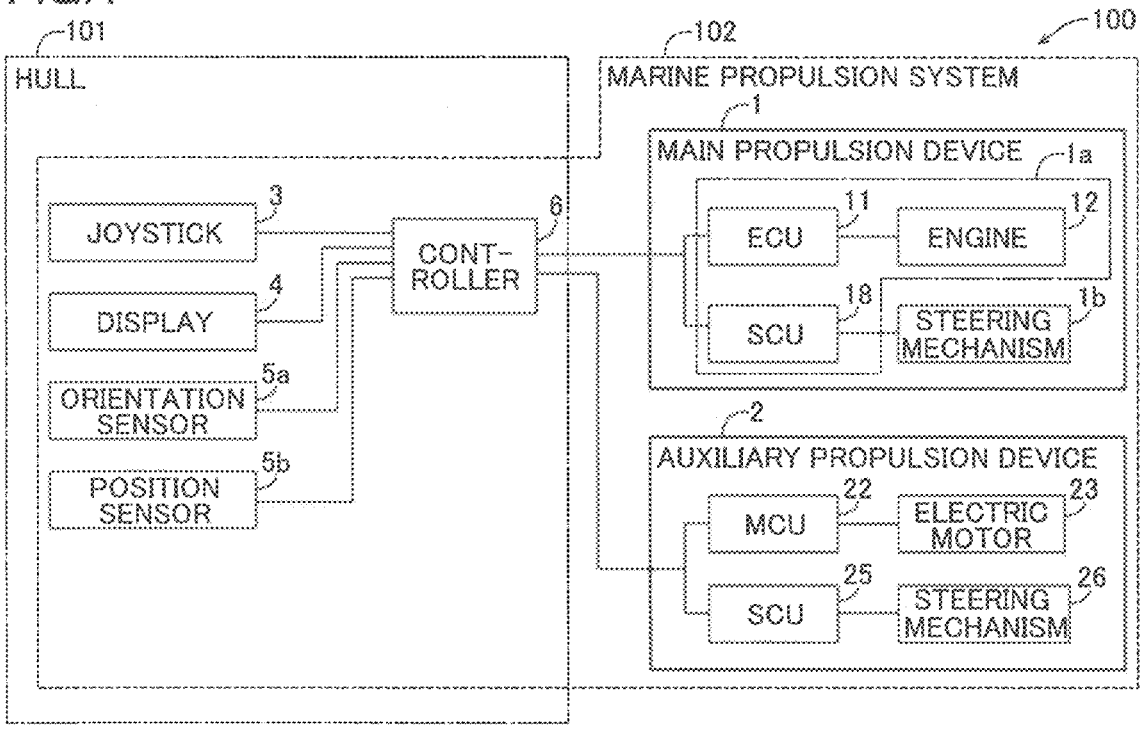
FIG. 4 is a block diagram of a marine vessel including a marine propulsion system and a hull according to a preferred embodiment of the present invention.
Figure 5:
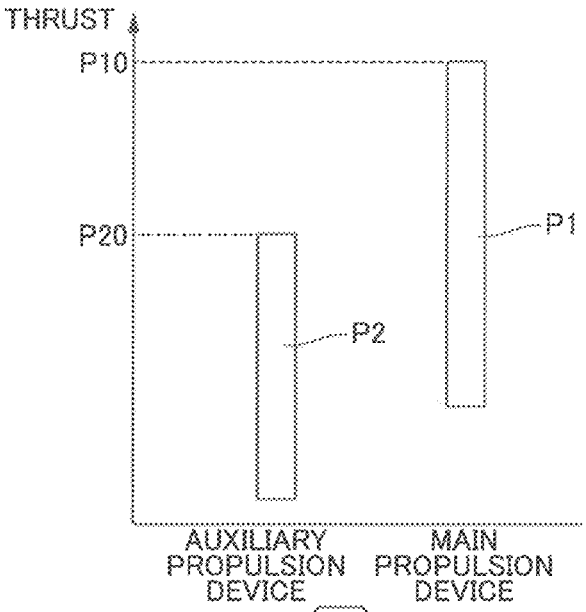
FIG. 5 is a diagram illustrating a power range of an engine of a main propulsion device and a power range of an electric motor of an auxiliary propulsion device according to a preferred embodiment of the present invention.

Only one main propulsion device 1 shown in FIGS. 2 and 4 is attached to the stern 101*b* (transom) of the hull 101. The main propulsion device 1 is an engine outboard motor including an engine 12 to drive the main propeller 10 to generate a thrust. The main propulsion device 1 is provided on a centerline α of the hull 101 in the right-left direction. The main propulsion device 1 rotates in the right-left direction to change the direction of the thrust of the main propeller 10.

The main propulsion device 1 includes a main propulsion device body 1*a* and a steering mechanism 1*b* provided on the main propulsion device body 1*a*. The main propulsion device body 1*a* is attached to the stern 101*b* of the hull 101 via the steering mechanism 1*b*.

The main propulsion device body 1*a* includes the main propeller 10, an engine control unit (ECU) 11, the engine 12, a cowling 13, a shift actuator 14, a drive shaft 15, a gearing 16, a propeller shaft 17, and a steering control unit (SCU) 18.

The ECU 11 is a control circuit, for example, and includes a central processing unit (CPU). The ECU 11 controls driving of the engine 12 based on a command from the controller 6.

The engine 12 is a drive source for the main propeller 10. The engine 12 is provided in an upper portion of the main propulsion device 1, and is an internal combustion engine driven by explosive combustion of gasoline, light oil, or the like. The engine 12 is covered with the cowling 13. As an example, the maximum output P10 of the power range P1 of the engine 12 is about 200 horsepower (see FIG. 5).

The shift actuator 14 switches the shift state of the main propulsion device 1 to any one of a forward movement state (shift F), a reverse movement state (shift R), and a neutral state (shift N) by switching the meshing of the gearing 16. When the shift state of the main propulsion device 1 is in the forward movement state, a thrust is generated from the main propeller 10 toward the FWD side, and when the shift state is in the reverse movement state, a thrust is generated from the main propeller 10 toward the BWD side. When the shift state is in the neutral state, a thrust is not generated from the main propeller 10.

When the shift state is switched, the meshing state of the gearing 16 of the main propulsion device 1 is changed, and thus a shift shock occurs in the gearing 16. That is, when the shift state is switched, the gearing 16 of the main propulsion device 1 generates relatively loud noise and vibrations.

The drive shaft 15 is connected to a crankshaft (not shown) of the engine 12 so as to transmit a power from the engine 12. The drive shaft 15 extends directly below the engine 12 with the main propeller 10 located in the water.

The gearing 16 transmits a rotational force from the drive shaft 15 to the propeller shaft 17. The main propeller 10 is attached to a rear end of the propeller shaft 17. The main propeller 10 generates a thrust in the axial direction of the propeller shaft 17 by rotating in the water. The main propeller 10 moves the hull 101 forward or rearward by switching the direction of the thrust between a forward direction and a rearward direction according to the rotational direction switched depending on the shift state.

The SCU 18 is a control circuit, for example, and includes a central processing unit (CPU). The SCU 18 controls driving of the steering mechanism 1*b* based on a command from the controller 6.

The steering mechanism 1*b* rotates the main propulsion device body 1*a* in the right-left direction with a steering shaft 19 extending in an upward-downward direction as a central axis of rotation. That is, the steering mechanism 1*b* changes the orientation of the main propulsion device body 1*a* in the right-left direction. When the orientation of the main propulsion device body 1*a* in the right-left direction changes, the direction of the thrust of the main propeller 10 also changes according to the orientation of the main propulsion device body 1*a*.

As an example, a right-left rotatable angle range θ1 (see FIG. 1) to change the direction of the thrust of the main propulsion device 1 is about 60 degrees (30 degrees on one side). As an example, the steering mechanism 1*b* includes a hydraulic cylinder (not shown) to apply a rotational force to the steering shaft 19, an electric pump (not shown) to pressure-feed oil to drive the hydraulic cylinder, etc.

Figure 3:
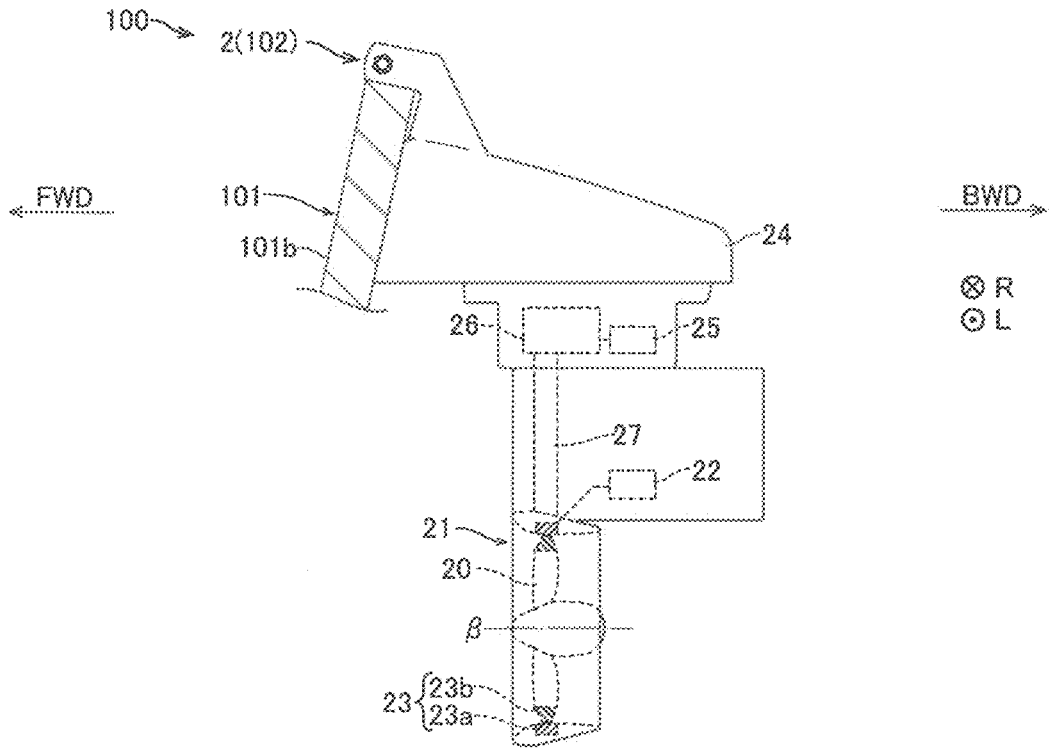
FIG. 3 is a side view showing an auxiliary propulsion device of a marine propulsion system according to a preferred embodiment of the present invention.

Only one auxiliary propulsion device 2 shown in FIGS. 3 and 4 is attached to the stern 101*b* (transom) of the hull 101. The auxiliary propulsion device 2 is an electric outboard motor including an electric motor 23 to drive the auxiliary propeller 20 to generate a thrust. The auxiliary propulsion device 2 is provided to one side of the centerline of the hull 101 in the right-left direction. Specifically, the auxiliary propulsion device 2 is located on the left side relative to the centerline α (see FIG. 1) of the hull 101 in the right-left direction. The auxiliary propulsion device 2 rotates in the right-left direction to change the direction of the thrust of the auxiliary propeller 20.

The auxiliary propulsion device 2 includes the auxiliary propeller 20, a duct 21, a motor control unit (MCU) 22, the electric motor 23, a cowling 24, a steering control unit (SCU) 25, and a steering mechanism 26.

The duct 21 is provided in a lower portion of the auxiliary propulsion device 2 with the auxiliary propeller 20 located in the water. The duct 21 has a cylindrical shape and supports the auxiliary propeller 20 on the inner peripheral side such that the auxiliary propeller 20 is rotatable. In FIG. 3, the central position of rotation of the auxiliary propeller 20 is indicated by a central axis B. That is, the auxiliary propeller 20 generates a thrust in a direction along the central axis B.

The MCU 22 is a control circuit, for example, and includes a central processing unit (CPU). The MCU 22 controls driving of the electric motor 23 based on a command from the controller 6.

The electric motor 23 is a drive source for the auxiliary propeller 20. The electric motor 23 is driven by power from a battery (not shown) mounted in the hull 101, for example. The maximum output P20 of the electric motor 23 of the auxiliary propulsion device 2 is smaller than the maximum output P10 of the engine 12 of the main propulsion device 1 (see FIG. 5). As an example, the maximum output P20 of the power range P2 of the electric motor 23 is about 20 horsepower.

The electric motor 23 includes a stator 23*a* integral and unitary with the duct 21 and a rotor 23*b* integral and unitary with the auxiliary propeller 20.

The cowling 24 covers an upper portion of the auxiliary propulsion device 2 such that electrical wiring and the like are not exposed. The cowling 24 does not rotate in the right-left direction unlike the auxiliary propeller 20 when the direction of the thrust in the right-left direction is changed. That is, the auxiliary propulsion device 2 does not rotate the entire auxiliary propulsion device 2 (auxiliary propulsion device body) excluding the steering mechanism 26 in the right-left direction but rotates only a portion (such as the duct 21 and the auxiliary propeller 20) of the auxiliary propulsion device 2 on the lower side, unlike the main propulsion device 1 that rotates the entire main propulsion device body 1*a* excluding the steering mechanism 1*b* in the right-left direction.

Therefore, the auxiliary propulsion device 2 does not need to rotate a relatively large structure such as the engine 12 of the main propulsion device 1 in the right-left direction, and thus a right-left rotatable angle range θ2 (see FIG. 1) to change the direction of the thrust is relatively large. As an example, the right-left rotatable angle range θ2 to change the direction of the thrust of the auxiliary propulsion device 2 is about 140 degrees (70 degrees on one side).

The auxiliary propeller 20 generates a thrust by rotating in the water. The drive source for the auxiliary propeller 20 is the electric motor 23, and thus the auxiliary propeller 20 is able to freely switch between forward rotation, reverse rotation (the direction of the thrust in the forward-rearward direction), and stop without generating a shift shock unlike the main propulsion device 1. In other words, the electric motor 23 is superior in quietness to the engine 12.

The SCU 25 is a control circuit, for example, and includes a central processing unit (CPU). The SCU 25 controls driving of the steering mechanism 26 based on a command from the controller 6.

The steering mechanism 26 is built into the auxiliary propulsion device 2. The steering mechanism 26 rotates the duct 21 in the right-left direction with a steering shaft 27 extending in the upward-downward direction as a central axis of rotation. When the orientation of the duct 21 in the right-left direction changes, the direction of the thrust of the auxiliary propeller 20 supported by the duct 21 also changes.

As an example, the steering mechanism 26 includes a reduction gear unit (not shown) to apply a rotational force to the steering shaft 27, an electric motor (not shown) to drive the reduction gear unit, etc.

Figure 6:
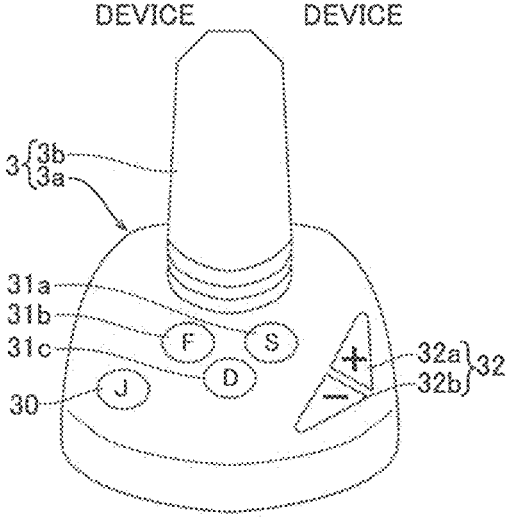
FIG. 6 is a diagram showing a joystick of a marine propulsion system according to a preferred embodiment of the present invention.

The joystick 3 shown in FIG. 6 is an operator to maneuver the marine vessel. The joystick 3 includes a main body 3*a* and a columnar stick 3*b* extending upward from the main body 3*a*. The stick 3*b* is a portion that is gripped by the user during maneuvering of the marine vessel.

The main body 3*a* includes a joystick button 30, three buttons to start an automatic marine vessel maneuvering mode including a Stay Point™ button 31*a*, a Fish Point™ button 31*b*, and a drift button 31*c*, and a thrust adjustment operation button 32. The thrust adjustment operation button 32 is an example of a "thrust adjustment operator".

The joystick button 30 receives operations to start and end a joystick mode. That is, the joystick button 30 switches between a normal state and a state (joystick mode) in which the joystick 3 is used to maneuver the marine vessel. In the normal state, the marine vessel is maneuvered using a remote control lever (not shown) to switch the shift state and adjust the engine speed, for example, and a steering wheel (not shown) to operate steering.

The Stay Point™ button 31*a* receives operations to start and end a Stay Point™ (fixed point holding) control. The Stay Point™ (fixed point holding) control refers to an automatic marine vessel maneuvering control to maintain the orientation of the bow 101*a* of the hull 101 at a target orientation and maintain the position of the hull 101 at the target point.

The Fish Point™ button 31*b* receives operations to start and end the Fish Point™ control. The Fish Point™ control refers to an automatic marine vessel maneuvering control to direct the stern 101*b* (or the bow 101*a*) of the hull 101 to the target point A1 by rotating the hull 101 and maintain the hull 101, the stern 101*b* (or the bow 101*a*) of which has been directed to the target point A1, at the target point by moving the hull 101 in the forward-rearward direction, as described above. The hull 101 does not move laterally in the Fish Point™ control.

The drift button 31*c* receives operations to start and end a drift control. The drift control refers to an automatic marine vessel maneuvering control to move the hull 101 by receiving external forces including wind and water flow while maintaining the orientation of the bow 101*a* of the hull 101 at the target orientation by rotating the hull 101.

The thrust adjustment operation button 32 receives an operation to adjust the level of the thrust magnitude of the marine vessel 100 (the main propulsion device 1 and the auxiliary propulsion device 2). The thrust adjustment operation button 32 includes a plus button 32*a* to increase the level of the thrust magnitude and a minus button 32*b* to decrease the level of the thrust magnitude.

As an example, there are five levels including levels 1 to 5 to set the level of the thrust magnitude. At level 1, the thrust magnitude is the smallest, and the thrust magnitude gradually increases in the order of levels 2, 3, 4, and 5. When the Fish Point™ control is started, the level of the thrust magnitude is automatically set to level 2, which is the second smallest from the bottom, at the time of start.

When the set level is level 2, 3, 4, or 5, the auxiliary propulsion device 2 rotates the hull 101, and the main propulsion devices 1 moves the hull 101 in the forward-rearward direction in the Fish Point™ control. When the set level is level 1, the auxiliary propulsion device 2 rotates and moves the hull 101 in the forward-rearward direction in the Fish Point™ control. That is, when the set level is level 1, the controller 6 does not drive the main propulsion device 1 in the Fish Point™ control.

Specifically, in the Fish Point™ control, the marine vessel 100 switches from a first driving state to a second driving state based on the thrust adjustment operation button 32 receiving an operation to change the thrust level to a predetermined level or less (an operation to change level 2 to level 1).

The first driving state refers to a state in which the main propeller 10 is driven to move the hull 101 in the forward-rearward direction while the auxiliary propeller 20 is stopped. The second driving state refers to a state in which the auxiliary propeller 20 is driven to move the hull 101 in the forward-rearward direction while the main propeller 10 is stopped.

In the joystick mode, the marine vessel 100 moves in the tilting direction of the stick 3*b* while maintaining the orientation of the bow 101*a* based on a tilting operation of the stick 3*b* by the user. In such a case, the orientations of the bow 101*a* before and after the movement are parallel or substantially parallel to each other. Predetermined calibration is performed in advance on the marine vessel 100 (controller 6) by a boat builder or the like such that the tilting direction of the stick 3*b* matches the actual moving direction of the hull 101.

In the joystick mode, the marine vessel 100 rotates in the twisting direction of the stick 3*b* based on a twisting operation of the stick 3*b* by the user.

In the joystick mode, the marine vessel 100 turns in the tilting and twisting directions of the stick 3*b* based on simultaneous tilting and twisting operations of the stick 3*b* by the user. The term "turn" indicates moving the hull 101 forward or rearward in the tilting direction of the stick 3*b* while gradually changing the orientation of the bow 101*a* in the twisting direction of the stick 3*b*.

In the Fish Point™ control, automatic marine vessel maneuvering is performed, and thus the stick 3*b* is not operated by the user. Furthermore, in the Fish Point™ control, the marine vessel 100 only rotates and moves the hull 101 in the forward-rearward direction, and does not move the hull 101 laterally and diagonally or turn the hull 101.

Figure 7:
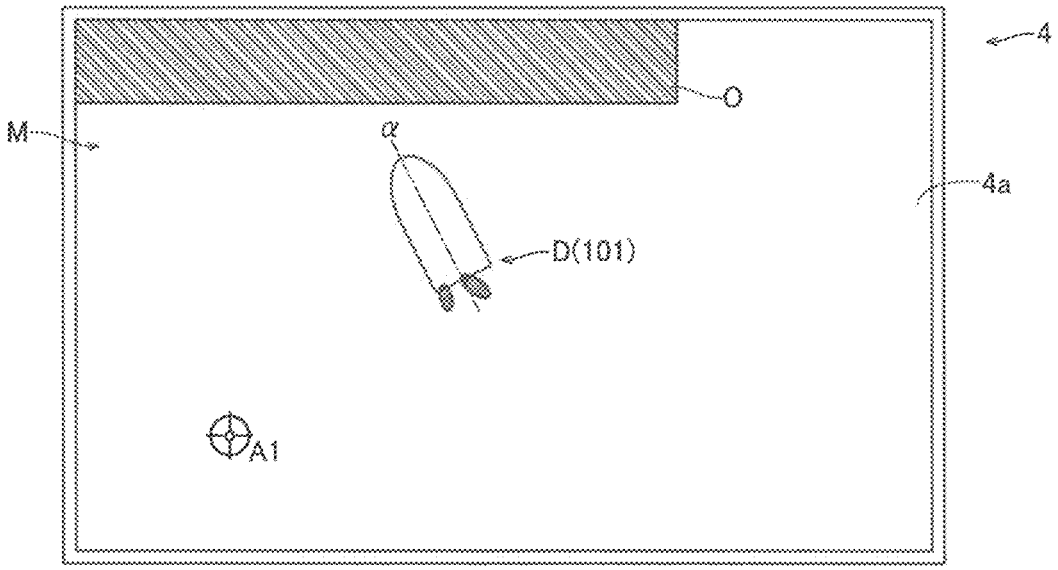
FIG. 7 is a diagram showing a display example for a Fish Point™ control of a display of a marine propulsion system according to a preferred embodiment of the present invention.

As shown in FIG. 7, the display 4 includes a touch panel 4*a*. As an example, when the Fish Point™ button 31*b* (see FIG. 6) is operated to start the Fish Point™ control, the display 4 displays a simplified model D of the hull 101 and a surrounding map M around the hull 101 including an obstacle 0 around the hull 101.

The display 4 receives the setting of the target point A1 in the Fish Point™ control based on a user's touch operation on the touch panel 4*a*. The setting of the target point A1 may be performed via another operator such as a panel operator (not shown). The display 4 displays the target point A1 set on the surrounding map M.

The orientation sensor 5*a* shown in FIG. 1 measures the current orientation of the marine vessel 100, which is the orientation (FWD) of the bow 101*a* of the marine vessel 100. The orientation sensor 5*a* is used to determine whether or not the stern 101*b* (or the bow 101*a*) has been directed to the target point A1 as a result of rotation in the Fish Point™ control, for example. As an example, the orientation sensor 5*a* includes an electronic compass.

The position sensor 5*b* measures the current position of the hull 101. The marine vessel 100 also acquires the current speed of the marine vessel 100 based on the time change of the current position of the hull 101 measured by the position sensor 5*b*. As an example, the position sensor 5*b* includes a global positioning system (GPS) device.

The controller 6 is a control circuit, for example, and includes a central processing unit (CPU).

Figure 8:
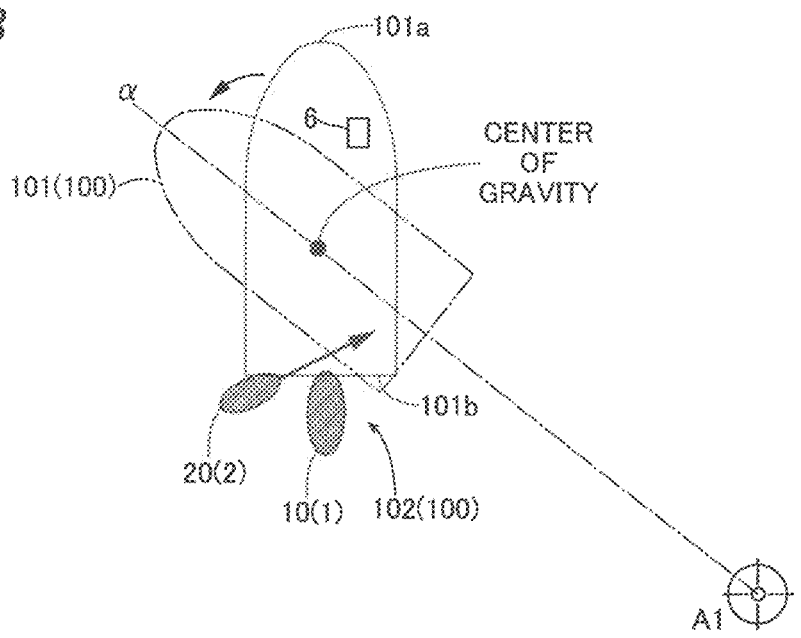
FIG. 8 is a diagram illustrating a control to rotate a hull by a controller of a marine propulsion system according to a preferred embodiment of the present invention.
Figure 9:
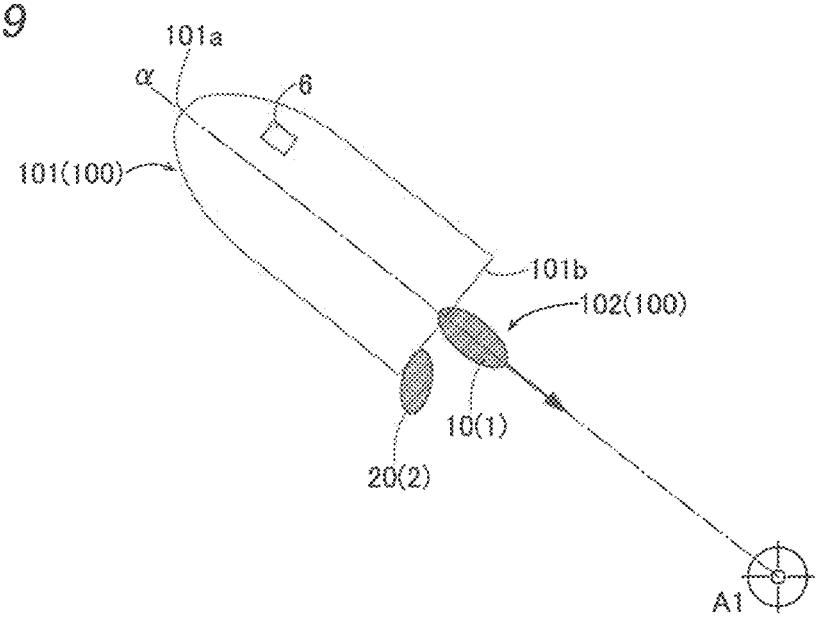
FIG. 9 is a diagram illustrating a control to move a hull in a forward-rearward direction by a controller of a marine propulsion system according to a preferred embodiment of the present invention.

In the Fish Point™ control, the controller 6 shown in FIGS. 8 and 9 directs the stern 101*b* (or the bow 101*a*) of the hull 101 to the target point A1 by driving the auxiliary propeller 20 while stopping the main propeller 10 to rotate the hull 101.

When the rotation described above is performed, the controller 6 rotates the hull 101 by driving the auxiliary propeller 20 while stopping the main propeller 10 without rotating the main propulsion device 1 in the right-left direction in the Fish Point™ control. When the hull 101 is rotated by driving the auxiliary propeller 20 in the Fish Point™ control, the main propulsion device 1 maintains the rudder angle of the main propeller 10 at a rudder angle along the centerline $\alpha$ of the hull 101 in the right-left direction while stopping the main propeller 10. That is, in the Fish Point™ control, the controller 6 performs a control such that the rotation is performed only by the auxiliary propeller 20 and the main propulsion device 1 is not rotated in the right-left direction from a position along the centerline $\alpha$ during the rotation.

The main propulsion device 1 is not rotated in the right-left direction from the position along the centerline $\alpha$ throughout the Fish Point™ control.

When the rotation described above is performed, the controller 6 rotates the hull 101 about the center of gravity of the hull on the spot while maintaining the position of the hull 101. Such a so-called "pivot turning" is not able to be provided with the main propulsion device 1 (engine outboard motor) having a relatively small right-left rotatable angle range $\theta$1 (see FIG. 1) to change the direction of the thrust.

In the Fish Point™ control, the controller 6 maintains the hull 101, the bow 101*a* or the stern 101*b* of which has been directed to the target point A1, at the target point A1 by moving the hull 101 in the forward-rearward direction.

When the movement in the forward-rearward direction described above is performed, the controller 6 moves the hull 101 in the forward-rearward direction by driving the main propeller 10 of the main propulsion device 1 while stopping the auxiliary propeller 20 of the auxiliary propulsion device 2 in the Fish Point™ control.

In the Fish Point™ control, the controller 6 performs a control to rotate the hull 101 and a control to move the hull 101 in the forward-rearward direction at different timings.

Figure 10:
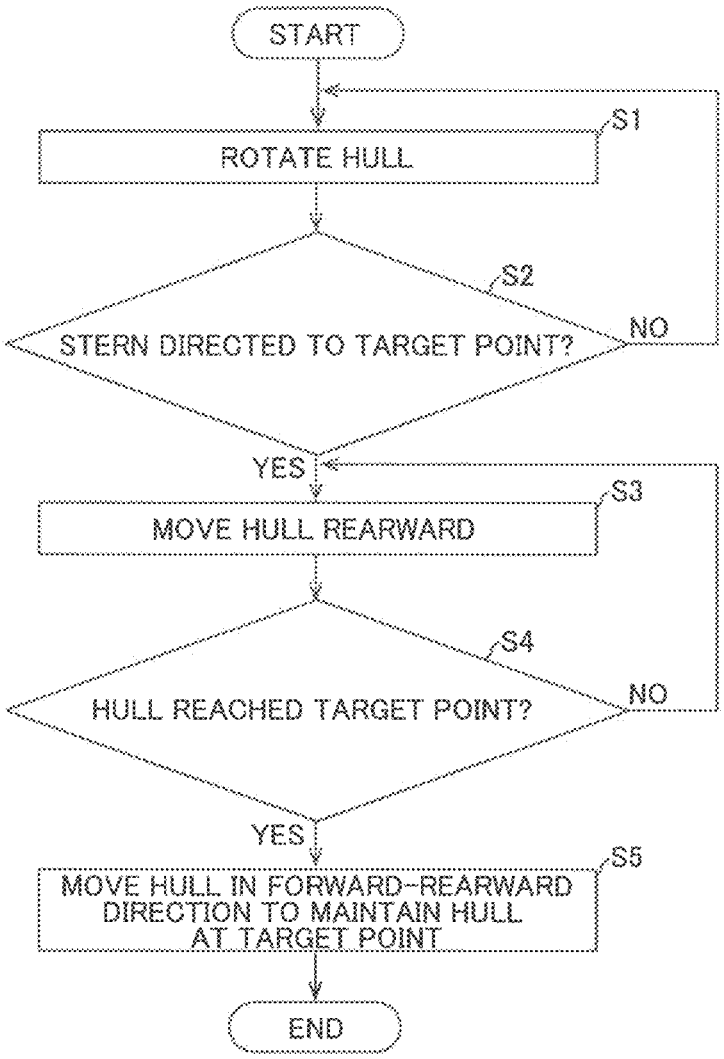
FIG. 10 is a flowchart of a Fish Point™ control process executed by a controller of a marine propulsion system according to a preferred embodiment of the present invention.

A Fish Point™ control process by the controller 6 of the marine propulsion system 102 is now described with reference to FIG. 10. A correction performed when the orientation of the stern 101*b* (or the bow 101*a*) is deviated from the target point A1 and the hull 101 is relatively far away from the target point A1 in the Fish Point™ control is described.

In step S1, the hull 101 is rotated to direct the stern 101*b* (or the bow 101*a*) to the target point A1 by driving the auxiliary propeller 20 while the main propeller 10 is stopped (see FIG. 8).

Then, in step S2, it is determined whether or not the stern 101*b* (or the bow 101*a*) has been directed to the target point A1 based on the measurement value of the orientation sensor 5*a*. That is, it is determined whether or not the target point A1 is positioned on the centerline $\alpha$ of the hull 101 in the right-left direction on the stern 101*b* (or the bow 101*a*) side. When it is determined in step S2 that the stern 101*b* (or the bow 101*a*) has been directed to the target point A1, the process advances to step S3, and when it is determined in step S2 that the stern 101*b* (or the bow 101*a*) has not been directed to the target point A1, the process returns to step S1.

Then, in step S3, the hull 101 is moved rearward (or forward) toward the target point A1 (see FIG. 9) by driving the main propeller 10 while the auxiliary propeller 20 is stopped.

Then, in step S4, it is determined whether or not the hull 101 has reached the target point A1 based on the measurement value of the position sensor 5*b*. When it is determined in step S4 that the hull 101 has reached the target point A1, the process advances to step S5, and when it is determined in step S4 that the hull 101 has not reached the target point A1, the process returns to step S3.

Then, in step S5, the hull 101 is repeatedly moved in the forward-rearward direction in the vicinity of the target point A1 in order to maintain the hull 101 at the target point A1.

According to the various preferred embodiments of the present invention described above, the following advantageous effects are achieved.

According to a preferred embodiment of the present invention, the marine propulsion system 102 includes the controller 6 configured or programmed to perform a control to rotate the hull 101 by driving the auxiliary propeller 20 driven by the electric motor 23 of the auxiliary propulsion device 2 operable to rotate in the right-left direction to change the direction of the thrust while stopping the main propeller 10 of the main propulsion device 1 in the automatic marine vessel maneuvering control (Fish Point™ control) to direct the bow 101*a* or the stern 101*b* of the hull 101 to the target point A1 by rotating the hull 101 and maintain the hull 101, the bow 101*a* or the stern 101*b* of which has been directed to the target point A1, at the target point A1 by moving the hull 101 in the forward-rearward direction. Accordingly, the hull 101 is rotated by the auxiliary propulsion device 2 by rotating the auxiliary propulsion device 2 in the right-left direction while the position of the hull 101 is maintained. That is, unlike turning accompanied by forward or rearward movement of the hull 101, the orientation of the hull 101 is changed by the auxiliary propulsion device 2 while the position of the hull 101 is maintained. Consequently, in the Fish Point™ control (the automatic marine vessel maneuvering control to direct the bow 101*a* or the stern 101*b* of the hull 101 including the main propulsion device 1 and the auxiliary propulsion device 2 to the target point A1 by rotating the hull 101 and maintain the hull 101 at the target point A1 by moving the hull 101 in the forward-rearward direction), the position holding accuracy is improved. Furthermore, the auxiliary propulsion device 2 includes the electric motor 23 to drive the auxiliary propeller 20 to generate a thrust. Accordingly, as compared with a case in which the auxiliary propulsion device 2 is an engine propulsion device, the amount of carbon dioxide emitted from the auxiliary propulsion device 2 is reduced. Thus, in the Fish Point™ control (the automatic marine vessel maneuvering control to direct the bow 101*a* or the stern 101*b* of the hull 101 including the main propulsion device 1 and the auxiliary propulsion device 2 to the target point A1 by rotating the hull 101 and maintain the hull 101 at the target point A1 by moving the hull 101 in the forward-rearward direction), the position holding accuracy is improved while environmental burdens associated with driving of the propulsion devices are reduced as much as possible.

According to a preferred embodiment of the present invention, the main propulsion device 1 is attached to the stern 101*b* and is provided on the centerline α of the hull 101 in the right-left direction, and the auxiliary propulsion device 2 is attached to the stern 101*b* and is provided to one side of the centerline of the hull 101 in the right-left direction. Accordingly, the auxiliary propulsion device 2 is spaced farther apart from the center of gravity of the hull 101 as compared with the main propulsion device 1, and thus a relatively large rotational moment is generated by the auxiliary propulsion device 2 at the time of rotating the hull 101. Therefore, the hull 101 is more quickly rotated.

According to a preferred embodiment of the present invention, the controller 6 is configured or programmed to move the hull 101 in the forward-rearward direction by driving the main propeller 10 of the main propulsion device 1 while stopping the auxiliary propeller 20 of the auxiliary propulsion device 2 in the automatic marine vessel maneuvering control (Fish Point™ control). Accordingly, rotation of the hull 101 and movement of the hull 101 in the forward-rearward direction are performed by different propulsion devices, and thus rotation of the hull 101 and movement of the hull 101 in the forward-rearward direction are smoothly switched.

According to a preferred embodiment of the present invention, the controller 6 is configured or programmed to rotate the hull 101 by driving the auxiliary propeller 20 while stopping the main propeller 10 without rotating the main propulsion device 1 in the right-left direction in the automatic marine vessel maneuvering control. Accordingly, the main propulsion device 1 is not rotated in the right-left direction when the hull 101 is rotated, and thus the hull 101 is prevented from swinging due to rotation of the main propulsion device 1 in the right-left direction. Furthermore, noise generated from the main propulsion device 1 is reduced, and thus scaring away fish during fishing, for example, is reduced or prevented.

According to a preferred embodiment of the present invention, the main propulsion device 1 is operable to maintain the rudder angle of the main propeller 10 at the rudder angle along the centerline α of the hull 101 in the right-left direction while stopping the main propeller 10 when the hull 101 is rotated by driving the auxiliary propeller 20 in the automatic marine vessel maneuvering control. Accordingly, when the hull 101 is rotated, the main propulsion device 1 is kept on standby at the rudder angle along the centerline α of the hull 101 in the right-left direction, which corresponds to the rudder angle of the main propeller 10, and thus a thrust is immediately generated in the forward-rearward direction from the main propeller 10 without changing the rudder angle of the main propulsion device 1 after the rotation is completed.

According to a preferred embodiment of the present invention, the controller 6 is configured or programmed to rotate the hull 101 about the center of gravity of the hull 101 on the spot while holding the position of the hull 101. Accordingly, the hull 101 is rotated on the spot without substantially changing the position of the hull 101, and thus the position holding accuracy is further improved in the Fish Point™ control (the automatic marine vessel maneuvering control to direct the bow 101*a* or the stern 101*b* of the hull 101 including the main propulsion device 1 and the auxiliary propulsion device 2 to the target point A1 by rotating the hull 101 and maintain the hull 101 at the target point A1 by moving the hull 101 in the forward-rearward direction).

According to a preferred embodiment of the present invention, the auxiliary propulsion device 2 has the right-left rotatable angle range θ2 to change the direction of the thrust larger than the right-left rotatable angle range of the main propulsion device 1. Accordingly, the hull 101 is rotated (pivot-turned) by the electric motor-driven (electric) auxiliary propulsion device 2 that has the right-left rotatable angle range θ2 to change the direction of the thrust larger than the right-left rotatable angle range of the main propulsion device 1 such that a change in the position of the hull 101 becomes smaller.

According to a preferred embodiment of the present invention, the marine propulsion system 102 further includes the thrust adjustment operation button 32 to receive an operation to adjust the levels of the thrust magnitudes of the main propulsion device 1 and the auxiliary propulsion device 2, and the marine propulsion system 102 switches from the first driving state in which the hull 101 is moved in the forward-rearward direction by driving the main propeller 10 while the auxiliary propeller 20 is stopped to the second driving state in which the hull 101 is moved in the forward-rearward direction by driving the auxiliary propeller 20 while the main propeller 10 is stopped, based on the thrust adjustment operation button 32 receiving the operation to change the levels of the thrust magnitudes to the predetermined levels or less in the automatic marine vessel maneuvering control. Accordingly, the first driving state is switched to the second driving state such that the hull 101 is rotated and moved in the forward-rearward direction by the auxiliary propeller 20 driven by the electric motor 23 in the Fish Point™ control (the automatic marine vessel maneuvering control to direct the bow 101*a* or the stern 101*b* of the hull 101 including the main propulsion device 1 and the auxiliary propulsion device 2 to the target point A1 by rotating the hull 101 and maintain the hull 101 at the target point A1 by moving the hull 101 in the forward-rearward direction), and thus quietness in the Fish Point™ control is improved, and environmental burdens are reduced.

According to a preferred embodiment of the present invention, the controller 6 is configured or programmed to perform a control to rotate the hull 101 and a control to move the hull 101 in the forward-rearward direction at the different timings in the automatic marine vessel maneuvering control. Accordingly, rotating the hull 101 to change the orientation of the bow 101*a* and moving the hull 101 in the forward-rearward direction to change the position of the hull 101 are separated from each other such that a change in the position of the hull 101 during rotation of the hull 101 is reduced or prevented, and a change in the orientation of the bow 101*a* during movement of the hull 101 is reduced or prevented.

According to a preferred embodiment of the present invention, the main propulsion device 1 is an engine outboard motor including the engine 12 to drive the main propeller 10 and provided on the centerline α of the hull 101 in the right-left direction, and the auxiliary propulsion device 2 is an electric outboard motor including the electric motor 23 to drive the auxiliary propeller 20 and provided to one side of the centerline of the hull 101 in the right-left direction. Accordingly, environmental burdens are reduced due to driving of the electric outboard motor, and the Fish Point™ control (the automatic marine vessel maneuvering control to direct the bow 101*a* or the stern 101*b* of the hull 101 including the main propulsion device 1 and the auxiliary propulsion device 2 to the target point A1 by rotating the hull 101 and maintain the hull 101 at the target point A1 by moving the hull 101 in the forward-rearward direction) is performed on the hull 101 including the engine outboard motor and the electric outboard motor.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while the process operations performed by the controller are described using a flowchart in a flow-driven manner in which processes are performed in order along a process flow for the convenience of illustration in preferred embodiments described above, the present invention is not restricted to this. In the present invention, the process operations performed by the controller may alternatively be performed in an event-driven manner in which the processes are performed on an event basis. In this case, the process operations performed by the controller may be performed in a complete event-driven manner or in a combination of an event-driven manner and a flow-driven manner.

While the marine propulsion system preferably includes only one main propulsion device in preferred embodiments described above, the present invention is not restricted to this. In the present invention, the marine propulsion system may alternatively include a plurality of main propulsion devices.

While the marine propulsion system preferably includes only one auxiliary propulsion device in preferred embodiments described above, the present invention is not restricted to this. In the present invention, the marine propulsion system may alternatively include a plurality of auxiliary propulsion devices.

While the main thruster of the main propulsion device is preferably the main propeller in preferred embodiments described above, the present invention is not restricted to this. In the present invention, the main thruster of the main propulsion device may alternatively be a jet that generates a thrust by jetting water.

While the auxiliary thruster of the auxiliary propulsion device is preferably the auxiliary propeller in preferred embodiments described above, the present invention is not restricted to this. In the present invention, the auxiliary thruster of the auxiliary propulsion device may alternatively be a jet that generates a thrust by jetting water.

While the main propulsion device is preferably provided on the centerline of the hull in the right-left direction in preferred embodiments described above, the present invention is not restricted to this. In the present invention, the main propulsion device may alternatively be shifted from the centerline of the hull in the right-left direction.

While the main propulsion device preferably includes the engine as a drive source for the main propeller in preferred embodiments described above, the present invention is not restricted to this. In the present invention, the main propulsion device may alternatively include an electric motor as a drive source for the main propeller.

While the main propulsion device and the auxiliary propulsion device are preferably outboard motors in preferred embodiments described above, the present invention is not restricted to this. In the present invention, the main propulsion device and the auxiliary propulsion device may alternatively be inboard-outboard motors, for example.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine propulsion system comprising:

a main propulsion device including a main thruster and operable to rotate in a right-left direction to change a direction of a thrust;

an auxiliary propulsion device including an electric motor to drive an auxiliary thruster to generate a thrust, operable to rotate in the right-left direction to change a direction of the thrust, and having a maximum output smaller than a maximum output of the main propulsion device; and a controller configured or programmed to perform an automatic marine vessel maneuvering control to direct a bow or a stern of a hull to a target point by rotating the hull and maintain the hull, the bow or the stern of which has been directed to the target point, at the target point by moving the hull in a forward-rearward direction by the main propulsion device; wherein the controller is configured or programmed to:

rotate the hull by driving the auxiliary thruster while stopping the main thruster of the main propulsion device moving the hull in the forward-rearward direction in the automatic marine vessel maneuvering control;

stop the auxiliary thruster when the stern or the bow has been directed to the target point; and then move the hull in the forward-rearward direction by the main propulsion device.

2. The marine propulsion system according to claim 1, wherein the main propulsion device is attached to the stern and provided on a centerline of the hull in the right-left direction; and the auxiliary propulsion device is attached to the stern and provided to one side of the centerline of the hull in the right-left direction.

3. The marine propulsion system according to claim 1, wherein the controller is configured or programmed to move the hull in the forward-rearward direction by driving the main thruster of the main propulsion device while stopping the auxiliary thruster in the automatic marine vessel maneuvering control.

4. The marine propulsion system according to claim 1, wherein the controller is configured or programmed to rotate the hull by driving the auxiliary thruster while stopping the main thruster without rotating the main propulsion device in the right-left direction in the automatic marine vessel maneuvering control.

5. The marine propulsion system according to claim 4, wherein the main propulsion device is operable to maintain a rudder angle of the main thruster along a centerline of the hull in the right-left direction while stopping the main thruster when the hull is rotated by driving the auxiliary thruster in the automatic marine vessel maneuvering control.

6. The marine propulsion system according to claim 1, wherein the controller is configured or programmed to rotate the hull about a center of gravity of the hull on a spot while holding a position of the hull.

7. The marine propulsion system according to claim 6, wherein the auxiliary propulsion device has a right-left rotatable angle range to change the direction of the thrust larger than a right-left rotatable angle range of the main propulsion device.

8. The marine propulsion system according to claim 3, further comprising:

a thrust adjustment operator to receive an operation to adjust thrust magnitudes of the main propulsion device and the auxiliary propulsion device; wherein the marine propulsion system is operable to switch from a first driving state in which the hull is moved in the forward-rearward direction by driving the main thruster while the auxiliary thruster is stopped to a second driving state in which the hull is moved in the forward-rearward direction by driving the auxiliary thruster while the main thruster is stopped, based on the thrust adjustment operator receiving an operation to change the thrust magnitudes to predetermined levels or less in the automatic marine vessel maneuvering control.

9. The marine propulsion system according to claim 1, wherein the controller is configured or programmed to perform a control to rotate the hull and a control to move the hull in the forward-rearward direction at different timings in the automatic marine vessel maneuvering control.

10. The marine propulsion system according to claim 1, wherein the main propulsion device is an engine outboard motor including an engine to drive a main propeller corresponding to the main thruster and provided on a centerline of the hull in the right-left direction; and the auxiliary propulsion device is an electric outboard motor including the electric motor to drive an auxiliary propeller corresponding to the auxiliary thruster and provided to one side of the centerline of the hull in the right-left direction.

11. A marine propulsion system comprising:

a main propulsion device including a main thruster and operable to rotate in a right-left direction to change a direction of a thrust;

an auxiliary propulsion device including an auxiliary thruster and operable to rotate in the right-left direction to change a direction of a thrust and having a maximum output smaller than a maximum output of the main propulsion device; and a controller configured or programmed to perform an automatic marine vessel maneuvering control to direct a bow or a stern of a hull to a target point by rotating the hull and maintain the hull, the bow or the stern of which has been directed to the target point, at the target point by moving the hull in a forward-rearward direction by the main propulsion device; wherein the controller is configured or programmed to:

rotate the hull by driving the auxiliary thruster to generate the thrust from the auxiliary propulsion device while stopping the main thruster of the main propulsion device moving the hull in the forward-rearward direction in the automatic marine vessel maneuvering control;

stop the auxiliary thruster when the stern or the bow has been directed to the target point; and then move the hull in the forward-rearward direction by the main propulsion device.

12. A marine vessel comprising:

a hull; and a marine propulsion system provided on or in the hull; wherein the marine propulsion system includes:

a main propulsion device including a main thruster and operable to rotate in a right-left direction to change a direction of a thrust;

an auxiliary propulsion device including an electric motor to drive an auxiliary thruster to generate a thrust, operable to rotate in the right-left direction to change a direction of the thrust, and having a maximum output smaller than a maximum output of the main propulsion device; and a controller configured or programmed to perform an automatic marine vessel maneuvering control to direct a bow or a stern of the hull to a target point by rotating the hull and maintain the hull, the bow or the stern of which has been directed to the target point, at the target point by moving the hull in a forward-rearward direction by the main propulsion device; and the controller is configured or programmed to:

rotate the hull by driving the auxiliary thruster while stopping the main thruster of the main propulsion device moving the hull in the forward-rearward direction in the automatic marine vessel maneuvering control;

stop the auxiliary thruster when the stern or the bow has been directed to the target point; and then move the hull in the forward-rearward direction by the main propulsion device.

13. The marine vessel according to claim 12, wherein the main propulsion device is attached to the stern and is provided on a centerline of the hull in the right-left direction; and the auxiliary propulsion device is attached to the stern and is provided to one side of the centerline of the hull in the right-left direction.

14. The marine vessel according to claim 12, wherein the controller is configured or programmed to move the hull in the forward-rearward direction by driving the main thruster of the main propulsion device while stopping the auxiliary thruster in the automatic marine vessel maneuvering control.

15. The marine vessel according to claim 12, wherein the controller is configured or programmed to rotate the hull by driving the auxiliary thruster while stopping the main thruster without rotating the main propulsion device in the right-left direction in the automatic marine vessel maneuvering control.

16. The marine vessel according to claim 15, wherein the main propulsion device is operable to maintain a rudder angle of the main thruster along a centerline of the hull in the right-left direction while stopping the main thruster when the hull is rotated by driving the auxiliary thruster in the automatic marine vessel maneuvering control.

17. The marine vessel according to claim 12, wherein the controller is configured or programmed to rotate the hull about a center of gravity of the hull on a spot while holding a position of the hull.

18. The marine vessel according to claim 17, wherein the auxiliary propulsion device has a right-left rotatable angle range to change the direction of the thrust larger than a right-left rotatable angle range of the main propulsion device.

19. The marine vessel according to claim 14, wherein the marine propulsion system further includes a thrust adjustment operator to receive an operation to adjust thrust magnitudes of the main propulsion device and the auxiliary propulsion device, and is operable to switch from a first driving state in which the hull is moved in the forward-rearward direction by driving the main thruster while the auxiliary thruster is stopped to a second driving state in which the hull is moved in the forward-rearward direction by driving the auxiliary thruster while the main thruster is stopped, based on the thrust adjustment operator receiving an operation to change the thrust magnitudes to predetermined levels or less in the automatic marine vessel maneuvering control.

20. The marine vessel according to claim 12, wherein the controller is configured or programmed to perform a control to rotate the hull and a control to move the hull in the forward-rearward direction at different timings in the automatic marine vessel maneuvering control.

* * * * *